US007938657B2

(12) United States Patent
Tang et al.

(10) Patent No.: US 7,938,657 B2
(45) Date of Patent: May 10, 2011

(54) CARD EDGE CONNECTOR WITH AN EJECTOR RETAINED AT A SIDE WALL THEREOF

(75) Inventors: Wen-Jun Tang, Kunshan (CN); Xue-Wu Bu, Kunshan (CN); Zhuang-Xing Li, Kunshan (CN)

(73) Assignee: Hon Hai Precision Ind. Co., Ltd, New Taipei (TW)

( * ) Notice: Subject to any disclaimer, the term of this patent is extended or adjusted under 35 U.S.C. 154(b) by 0 days.

(21) Appl. No.: 12/607,006

(22) Filed: Oct. 27, 2009

(65) Prior Publication Data

US 2010/0105248 A1 Apr. 29, 2010

(30) Foreign Application Priority Data

Oct. 27, 2008 (CN) ..... 2008 2 0302549

(51) Int. Cl.
*H01R 13/62* (2006.01)

(52) U.S. Cl. ..... 439/160; 439/157

(58) Field of Classification Search ..... 439/160, 439/157, 352
See application file for complete search history.

(56) References Cited

U.S. PATENT DOCUMENTS

| | | | | |
|---|---|---|---|---|
| 4,975,073 | A * | 12/1990 | Weisman | 439/157 |
| 5,413,497 | A | 5/1995 | Lwee | |
| 6,379,168 | B1 | 4/2002 | Wang | |
| 6,955,550 | B2 * | 10/2005 | Schlack | 439/160 |
| 7,121,862 | B2 | 10/2006 | Tang et al. | |
| 7,252,523 | B1 * | 8/2007 | Pennypacker et al. | 439/160 |
| 7,494,354 | B2 * | 2/2009 | Mon et al. | 439/160 |
| 7,677,907 | B2 * | 3/2010 | Guan et al. | 439/157 |
| 2005/0196992 | A1 * | 9/2005 | Tanigawa | 439/160 |

FOREIGN PATENT DOCUMENTS

TW M282377 12/2005

* cited by examiner

*Primary Examiner* — Gary F. Paumen
(74) *Attorney, Agent, or Firm* — Wei Te Chung; Andrew C. Cheng; Ming Chieh Chang

(57) ABSTRACT

A card edge connector (100) includes an elongate insulative housing (1), a number of contacts (2) and an ejector (3) retained on the insulative housing (1). The insulative housing (1) defines a pair of opposed side walls (11) and a central slot (12) between the side walls (11). The side wall (11) has a fitting section (13) at one end thereof. The fitting section (13) defines a cavity (131) extending therethrough along a width direction, and a slit (134) spaced apart from the cavity (131) along a length direction. The ejector (3) has a base (31) retained on the fitting section (13) and a spring tab (32) sandwiched between the insulative housing (1) and the base (31). The spring tab (32) defines two ends one of which being retained in the slit (134) and another abutting against an inner side of the base (31).

16 Claims, 5 Drawing Sheets

CARD EDGE CONNECTOR WITH AN EJECTOR RETAINED AT A SIDE WALL THEREOF

BACKGROUND OF THE INVENTION

1. Field of the Invention

The present invention relates to card edge connectors, more particularly to card edge connectors with an ejector retained at a side wall thereof.

2. Description of Related Art

Card edge connectors are employed widely in computers to receive a memory card, graphic card, network interface card et al. The card edge connectors usually have an elongated housing, a plurality of contacts retained in the housing for electrically connecting a corresponding mating card, and at least an ejector at one end thereof for locking the mating card. The housing has a pair of side walls and a central slot between the side walls for receiving the mating card. The ejector can be integrally extending outwardly from one end of the housing along a length direction, or manufactured dividedly with the housing and attached to one end of the housing for locking or ejecting the mating card. The ejector has an operating portion extending along the length direction of the housing, and a projection extending along a width direction for locking the mating card. The operating portion can move along a width direction for locking or ejecting the mating card. Because the ejector extends along the length direction which increases a length of the housing, the card edge connector has a large volume which holds a large space of the computer. It is disadvantageous to a miniature development direction of the electronic industry. In addition, the ejector is made of insulative material which has a less elasticity as being used after a long time.

Hence, an improved card edge connector is desired to overcome the above problems.

BRIEF SUMMARY OF THE INVENTION

According to one aspect of the present invention, a card edge connector comprises: an elongate insulative housing defining a pair of opposed side walls and a central slot between the side walls, the side wall having a fitting section at one end thereof, the fitting section defining a cavity extending therethrough along a width direction of the insulative housing, and a slit spaced apart from the cavity along a length direction of the insulative housing; a plurality of contacts retained in the insulative housing; and an ejector attached to the fitting section along the width direction, the ejector having a base retained on the fitting section and a spring tab sandwiched between the insulative housing and the base, the spring tab defining two ends one of which being retained in the slit and another abutting against an inner side of the base.

According to another aspect of the present invention, a card edge connector defining a central slot for receiving an electronic card, comprises: an elongate insulative housing having a pair of opposed side walls, the central slot is formed between the side walls, the side wall has a fitting section at one end thereof, the fitting section defining a cavity extending therethrough along a width direction of the insulative housing and a pair of axes holes at upper and lower sides of the cavity; a plurality of contacts retained in the insulative housing; a base rotatably retained on the fitting section, the base having a pair of pivots engaging with the axes holes respectively and a projection extending through the cavity for locking with the electronic card; and a spring tab retained on the insulative housing and being sandwiched between the insulative housing and the base to urge the base rotating around the pivots.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENTS

Figure 1:
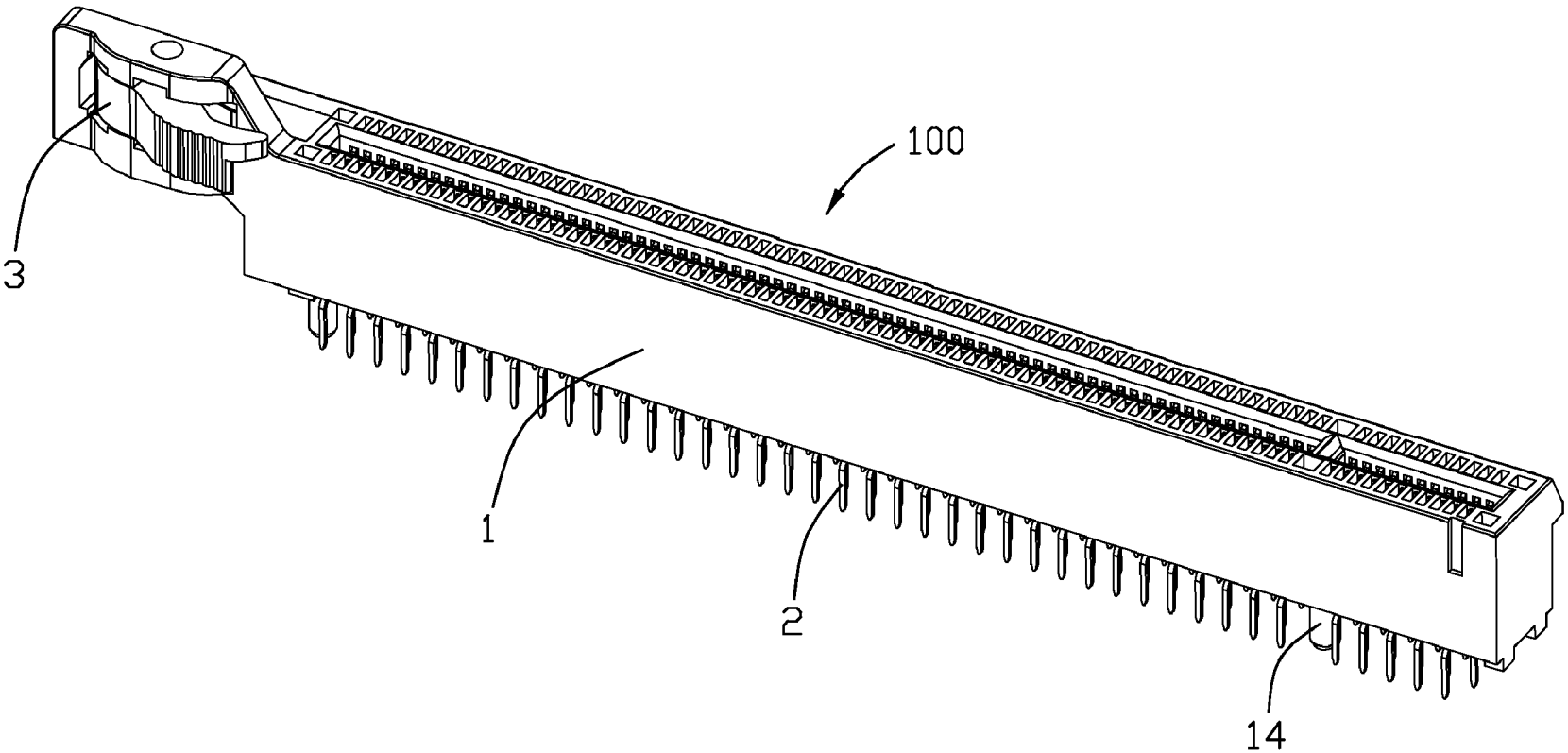
FIG. 1 is a perspective view of a card edge connector according to the present invention.

In the following description, numerous specific details are set forth to provide a thorough understanding of the present invention. However, it will be obvious to those skilled in the art that the present invention may be practiced without such specific details. In other instances, well-known circuits have been shown in block diagram form in order not to obscure the present invention in unnecessary detail. For the most part, details concerning timing considerations and the like have been omitted inasmuch as such details are not necessary to obtain a complete understanding of the present invention and are within the skills of persons of ordinary skill in the relevant art.

Reference will be made to the drawing figures to describe the present invention in detail, wherein depicted elements are not necessarily shown to scale and wherein like or similar elements are designated by same or similar reference numeral through the several views and same or similar terminology.

Figure 2:
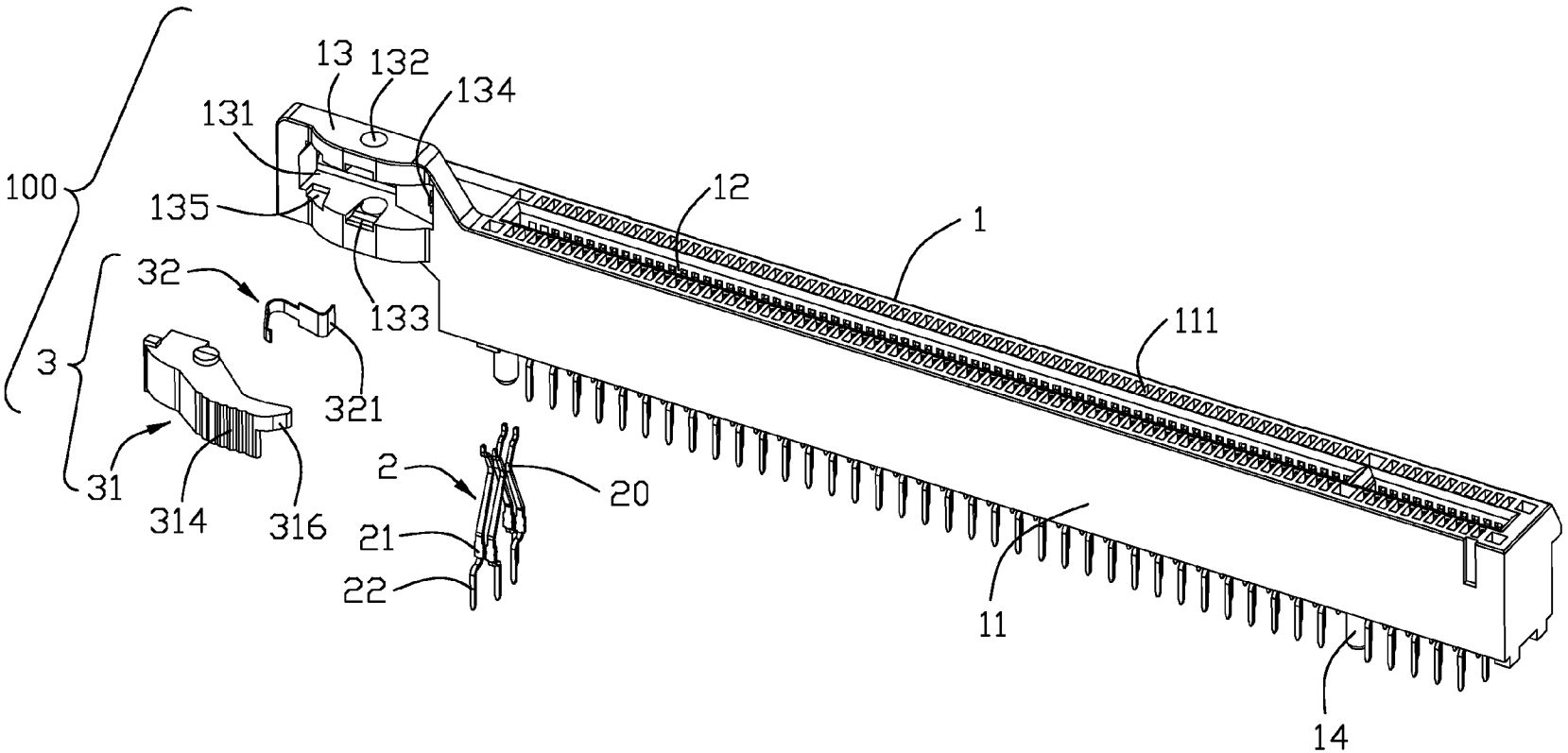
FIG. 2 is an exploded perspective view of the card edge connector shown in FIG. 1.
Figure 3:
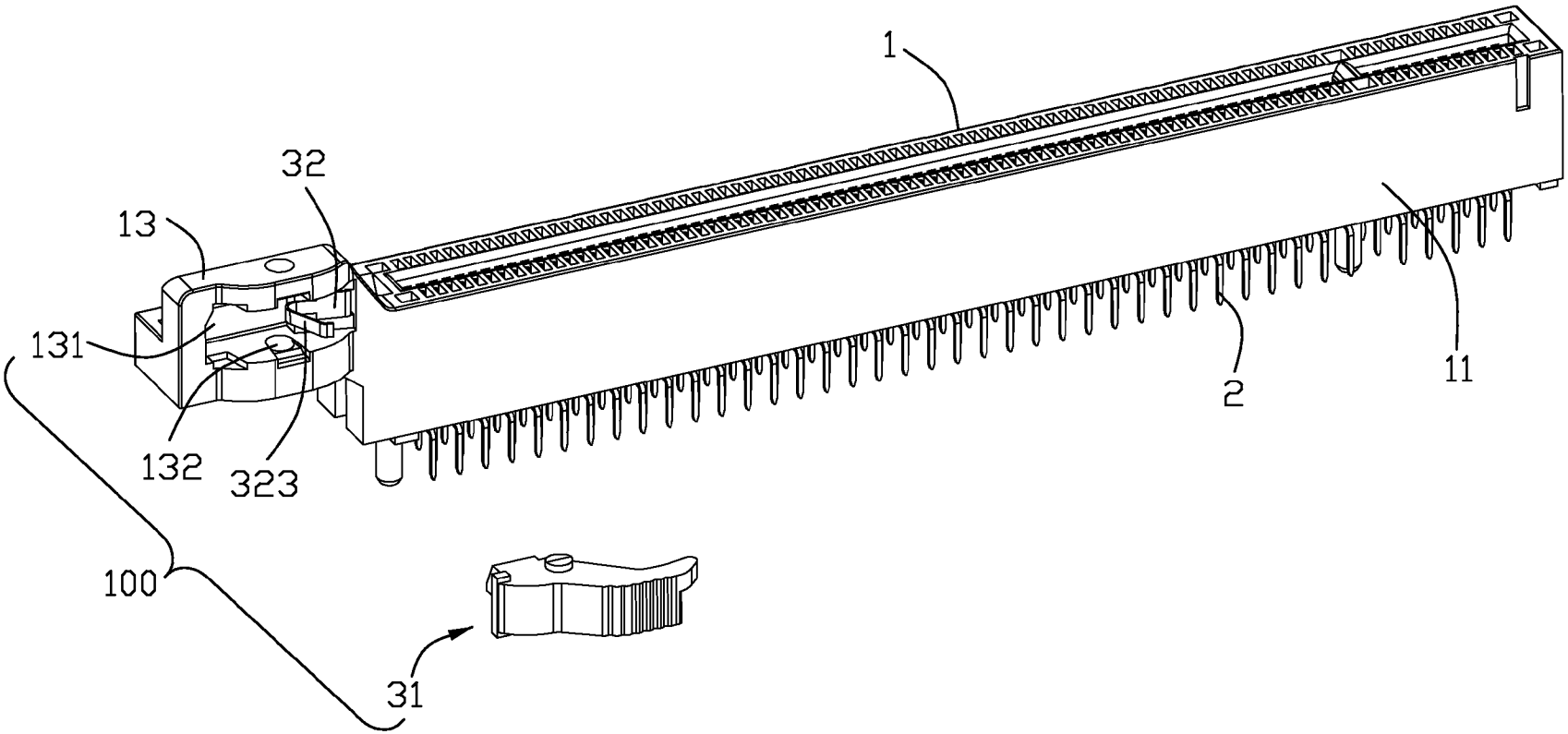
FIG. 3 is a partially exploded perspective view of the card edge connector shown in FIG. 1.
Figure 4:
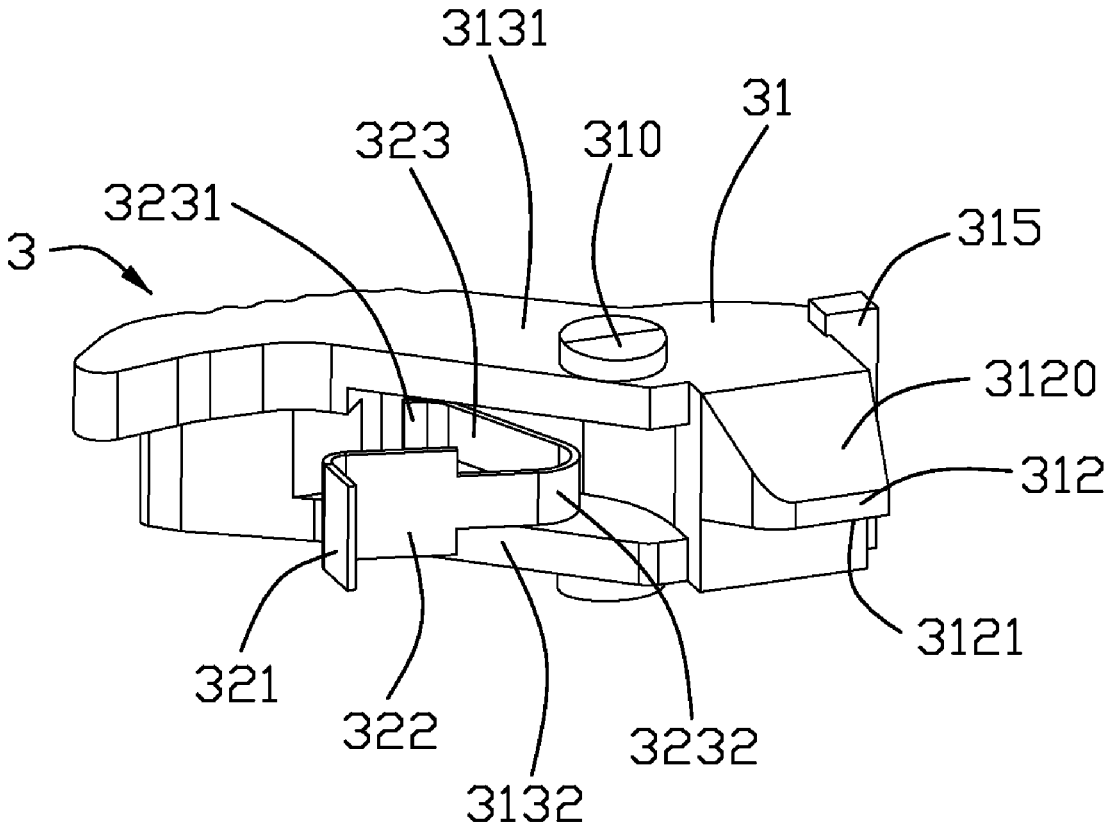
FIG. 4 a perspective view of an ejector of the card edge connector shown in FIG. 1.
Figure 5:
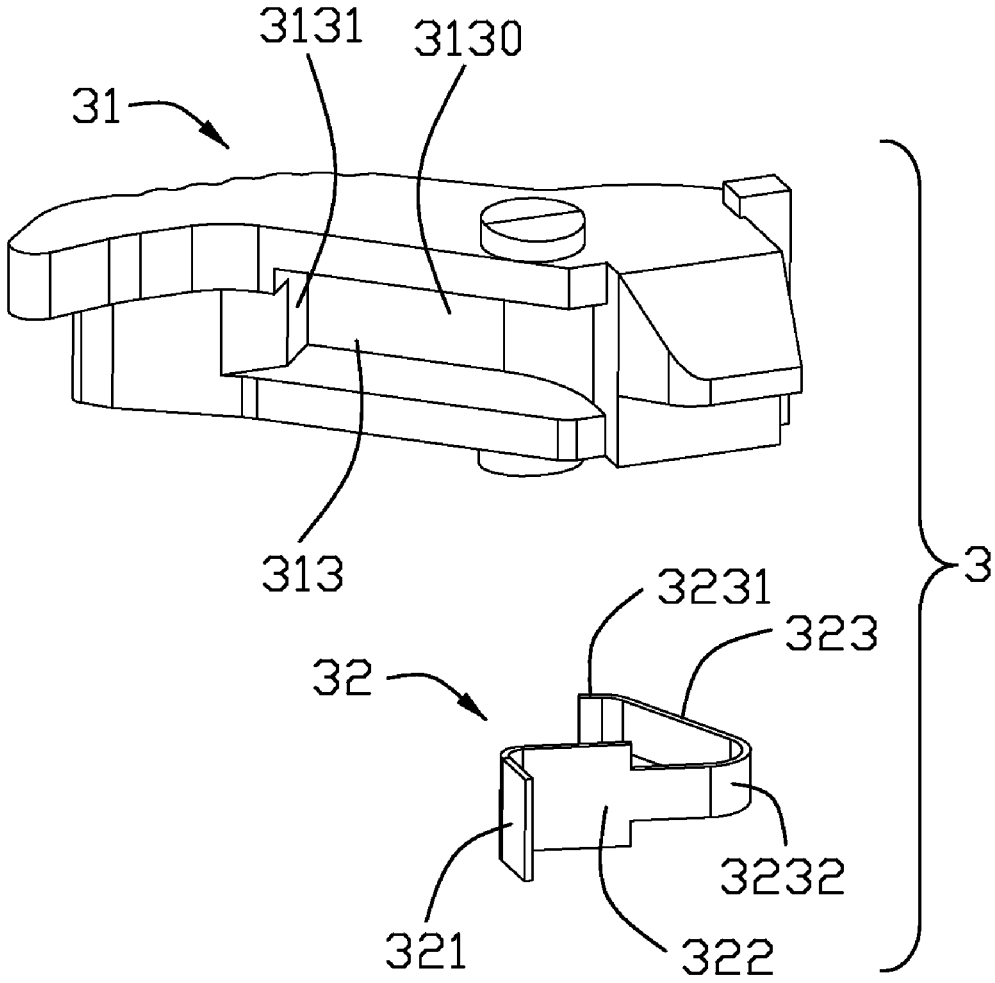
FIG. 5 is an exploded view of the ejector shown in FIG. 4.

Referring to FIGS. 1-5, a card edge connector 100 for connecting with an electronic card (not shown) according to the present invention is disclosed. The card edge connector 100 comprises an elongate insulative housing 1, a plurality of contacts 2 retained in the insulative housing 1, and an ejector or locker 3 rotatably retained on one side of the insulative housing 1.

The insulative housing 1 has a pair of opposed side walls 11 extending along a length direction of the insulative housing 1, and a central slot 12 between the side walls 11. The central slot 12 extends along the length direction for receiving an edge portion of the electronic card. The side wall 11 has a fitting section 13 at one end thereof to retain the ejector 3. The fitting section 13 extends out of the side wall 11 and presents as an arc-shape. The fitting section 13 defines a cavity 131 extending therethrough along a width direction perpendicular to the length direction of the insulative housing 1, and a pair of axes holes 132 at upper and lower sides of the cavity 131. The axes holes 132 have a same central axis along an upper to down direction. The fitting section 13 has a pair of guiding face 133 at outer sides of the axes holes 132 for installing the ejector 3 conveniently. The fitting section 13 defines a slit 134 at one side thereof and spaced apart from the cavity 131 along the length direction, and a depression 135 at another side thereof. Each side wall 11 defines a plurality of passageways 111 extending therethrough along the upper to down direction of the insulative housing 1 and communicating with the central slot 12. The insulative housing 1 has a post 14 extending downwardly for positioning the card edge connector 100 to a circuit board (not shown).

The contacts 2 are retained in the insulative housing 1 and each has a securing portion 21 engaging with the passageway 111, a contact portion 20 extending into the central slot 12 from one end of the securing portion 21, and a tail portion 22 extending downwardly from another end of the securing portion 21.

The ejector 3 is rotatably retained on the fitting section 13, and comprises a base 31 attached to the fitting section 13 and a spring tab 32 sandwiched between the insulative housing 1 and the base 31. The base 31 has a pair of pivots 310 at upper and lower sides thereof to engage with the axes holes 132, and a projection or locking head 312 extending inwardly from an inner side of the base 31. The projection 312 extends through the cavity 131 and beyond an inner side of the side wall 11 for locking the electronic card. The projection 312 has an inclined face 3120 at an upper side thereof for guiding the electronic card inserted into the central slot 12, and a locking face 3231 at a lower side thereof for preventing the electronic card from drawing out of the central slot 12. The base 31 defines a recess 313 at an inner side thereof. The recess 313 is formed with an upper wall 3131, a lower wall 3132 and an inner side wall 3130 between the upper wall 3131 and the lower wall 3132. The inner side wall 3130 extends obliquely along the length direction to abut against the spring tab 32. The recess 313 has a limiting wall 3131 perpendicular to the inner side wall 3130 and located at an inner end thereof to resist the spring tab 32. The base 31 also has an operating portion 314 and a block 315 at opposite two ends thereof. The block 315 engages with the depression 135 for preventing the ejector 3 from overly rotating outwardly. The operating portion 314 has a resisting portion 316 at a free end thereof to abut against the side wall 11 as the operating portion 314 moving inwardly overly.

The spring tab 32 has a positioning section 321 at one end thereof, a depending section 323 at another end thereof and a middle section 322 connecting the positioning section 321 and the depending section 323 together. The position section 321 is perpendicular to the side wall 11 and engages with the slit 134 to fix the spring tab 32 to the insulative housing 1. The middle section 322 extends toward the cavity 131 from an outer end of the positioning section 321. The depending section 323 bends reversely from a free end of the middle section 322 and forms a V-shaped structure with the middle section 322. The depending section 323 is received in the recess 313 and abuts against the inner side wall 3130. The depending section 323 also has a limiting portion 3231 at a free end thereof to resist the limiting wall 3131, and an outer apex 3132 located at an inner side of the axes line of the pivots 310. Therefore, one end of the spring tab 32 is retained in the insulative housing 1, and another end of the spring tab 32 abuts against the inner side of the base 31 to urge the ejector 3 rotating around the pivot 310. The projection 312 is located at an outer side of the pivots 310 along the length direction. The limiting portion 3231 and positioning section 321 are located at an inner side of the pivots 310 along the length direction.

In assembly, retaining the positioning section 321 of the spring tab 32 to the slit 134 firstly, then installing the base 31 to the fitting section 13 along the width direction, the spring tab 32 will be sandwiched between the insulative housing 1 and the base 31. It is obvious that the card edge connector 100 has a simple structure and is assembled conveniently. Besides, the ejector 3 is attached to one side of the insulative housing 1, therefore, the length of the insulative housing 1 is decreased. The card edge connector 100 in the present invention has a small volume which adapts to a miniature development direction of the electronic industry. In addition, the spring tab 32 has good elasticity to prolong a life of the card edge connector 100.

The positioning section 321 of the spring tab 32 in the present invention is installed to the insulative housing 1, of course, the positioning section 321 of the spring tab 32 can be insert molded to the insulative housing 1 in other embodiment for retaining the spring tab 32 to the insulative housing 1, which can be decrease the assembly process.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

We claim:

1. A card edge connector comprising:

an elongate insulative housing defining a pair of opposed side walls and a central slot between the side walls, the side wall having a fitting section at one end thereof, the fitting section defining a cavity extending therethrough along a width direction of the insulative housing, and a slit spaced apart from the cavity along a length direction of the insulative housing;

a plurality of contacts retained in the insulative housing; and an ejector attached to the fitting section along the width direction, the ejector having a base retained on the fitting section and a spring tab sandwiched between the insulative housing and the base, the spring tab defining two ends one of which being retained in the slit and another abutting against an inner side of the base;

wherein the spring tab has a positioning section at one end thereof and perpendicular to the side wall, a depending section at another end thereof, and a middle section connecting the positioning section and the depending section together;

wherein the base defines a recess to receive the depending section, the recess is formed with an upper wall, a lower wall and an inner side wall extending obliquely along the length direction, the depending section is located between the upper and lower walls and abuts against the inner side wall.

2. The card edge connector as claimed in claim 1, wherein the positioning section engages with the slit to fix the spring tab to the insulative housing, the middle section extends toward the cavity from the positioning section, the depending section bends reversely relative to the middle section and forms a V-shaped structure with the middle section.

3. The card edge connector as claimed in claim 1, wherein the recess has a limiting wall perpendicular to the inner side wall, the depending section has a limiting portion at a free end thereof to resist the limiting wall.

4. The card edge connector as claimed in claim 3, wherein the fitting section defines a pair of axes holes at upper and lower sides of the cavity and communicating with the cavity, the base has a pair of pivots at upper and lower sides thereof to engage with the axes holes and a projection extending through the cavity from the inner side thereof.

5. The card edge connector as claimed in claim 4, wherein the projection is located at an outer side of the pivots along the length direction, the limiting portion and positioning section are located at an inner side of the pivots along the length direction.

6. The card edge connector as claimed in claim 5, wherein the depending section defines an outer apex located at an inner side of the axes line of the pivot.

7. The card edge connector as claimed in claim 4, wherein the projection has an inclined face at an upper side thereof for guiding an electronic card inserted into the central slot, and a locking face at a lower side thereof for preventing the electronic card from drawing out of the central slot.

8. The card edge connector as claimed in claim 1, wherein the base has an operating portion and a block at opposite two ends thereof, the fitting section defines a depression to receive the block for preventing the ejector from overly rotating outwardly.

9. The card edge connector as claimed in claim 1, wherein the operating portion has a resisting portion to abut against the side wall as the operating portion moving inwardly overly.

10. A card edge connector defining a central slot for receiving an electronic card, comprising:

an elongate insulative housing having a pair of opposed side walls, the central slot is formed between the side walls, the side wall has a fitting section at one end thereof, the fitting section defining a cavity extending therethrough along a width direction of the insulative housing and a pair of axes holes at upper and lower sides of the cavity;

a plurality of contacts retained in the insulative housing;

a base rotatablely retained on the fitting section, the base having a pair of pivots engaging with the axes holes respectively and a projection extending through the cavity for locking with the electronic card; and a spring tab retained on the insulative housing and being sandwiched between the insulative housing and the base to urge the base rotating around the pivots in a clockwise direction;

wherein the spring tab has a positioning section retained in the insulative housing, a depending section abutting against an inner side of the base, and a middle section connecting the positioning section and the depending section together;

wherein the positioning section is perpendicular to the side wall, the middle section extends along a length direction of the insulative housing from the positioning section, and the depending section bends reversely relative to the middle section to form a V-shaped structure with the middle section.

11. The card edge connector as claimed in claim 10, wherein the base defines a recess to receive the depending section, the recess is formed with an upper wall, a lower wall and an inner side wall extending obliquely along the length direction, the depending section is located between the upper and lower walls and abuts against the inner side wall.

12. The card edge connector as claimed in claim 11, wherein the recess has a limiting wall perpendicular to the inner side wall, the depending section has a limiting portion at a free end thereof to abut against the limiting wall.

13. The card connector as claimed in claim 12, wherein the projection is located at an outer side of the pivots along the length direction, the limiting portion and positioning section are located at an inner side of the pivots along the length direction, the depending section defines an outer apex located at an inner side of the axes line of the pivot.

14. A card edge connector comprising:

an elongated insulative housing defining an elongated receiving slot for receiving a daughter card;

a plurality of contacts disposed in the housing with contacting sections extending into the receiving slot;

a locker pivotally having a locking head thereof and assembled to one end of the housing about a pivot shaft extending along a vertical direction for determining an inner position where the locking head is closer to the receiving slot in a transverse direction for locking the daughter card, and an outer position where the locking head is farther from the receiving slot in said transverse direction for unlocking the daughter card; and a spring tab defining a V-shaped structure having a first arm received in a recess of the locker and a second arm securely abutting against the housing so as to constantly urge said locker to the outer position.

15. The card edge connector as claimed in claim 14, wherein said second arm defines an enlarged end in comparison with the first arm.

16. The card edge connector as claimed in claim 14, wherein said spring tab is not engaged with the pivot shaft and independently works.

* * * * *